US009968147B1

(12) United States Patent
Lindquist

(10) Patent No.: US 9,968,147 B1
(45) Date of Patent: May 15, 2018

(54) GARMENT HAVING AN IMPROVED POCKET CONSTRUCTION

(71) Applicant: VF Jeanswear Limited Partnership, Greensboro, NC (US)

(72) Inventor: John D. Lindquist, Liberty, NC (US)

(73) Assignee: Wrangler Apparel Corp., Wilmington, DE (US)

( * ) Notice: Subject to any disclaimer, the term of this patent is extended or adjusted under 35 U.S.C. 154(b) by 1043 days.

(21) Appl. No.: 13/653,943

(22) Filed: Oct. 17, 2012

Related U.S. Application Data

(60) Provisional application No. 61/547,994, filed on Oct. 17, 2011.

(51) Int. Cl.
*A41D 27/20* (2006.01)

(52) U.S. Cl.
CPC ..... *A41D 27/20* (2013.01)

(58) Field of Classification Search
CPC ..... A41D 27/20; A41D 27/205
See application file for complete search history.

(56) References Cited

U.S. PATENT DOCUMENTS

| | | | | | |
|---|---|---|---|---|---|
| 472,273 | A * | 4/1892 | Rupprecht | A41F 9/02 | 2/237 |
| 934,660 | A * | 9/1909 | Dean | A41D 27/20 | 2/254 |
| 1,496,683 | A * | 6/1924 | Sternberg | A41D 27/20 | 2/247 |
| 2,087,123 | A * | 7/1937 | Serak | A41D 27/20 | 2/253 |
| 2,215,834 | A * | 9/1940 | Magliano | A41D 27/20 | 112/423 |
| 2,277,832 | A * | 3/1942 | Rhoads | A41D 1/06 | 2/234 |
| 2,409,025 | A | 10/1946 | Falk | | 2/248 |
| 2,519,126 | A | 8/1950 | Falk | | 2/247 |
| 2,577,318 | A | 10/1951 | Falk | | 2/247 |
| 2,800,663 | A | 7/1957 | Falk | | 2/247 |
| 2,902,694 | A | 8/1959 | Falk | | 2/274 |
| 2014/0352024 | A1* | 12/2014 | Echigoya | A41D 27/20 | 2/69 |

* cited by examiner

*Primary Examiner* — Anna Kinsaul
(74) *Attorney, Agent, or Firm* — MacCord Mason PLLC

(57) ABSTRACT

A garment having an improved pocket construction. The garment includes a garment body and at least one partial bag pocket attached to the garment body. The garment may also include a finished edge along the lower portion of the at least one partial bag pocket for providing reinforcement. Finally, the garment may also include a closure.

6 Claims, 20 Drawing Sheets

602 COVERSTITCH

605 COVERSTITCH

607 FLAT SEAMING STITCH

Front side view of pocket facing and pocket fabric

Back side view of pocket facing and pocket fabric

Stitch - turn - Stitch Method

Step 1

1. packet material and pocket facing part are lined up edge to edge and sewn safety stitch seam 2. part are turned and 301 top stitch sewn in safety stitch seam 3. pocket fabric is folded and bottom sewn closed Stitch - turn - Stitch Method Step 2

GARMENT HAVING AN IMPROVED POCKET CONSTRUCTION

BACKGROUND OF THE INVENTIONS

(1) Field of the Inventions

The present inventions relate generally to apparel and, more particularly, to a garment having an improved pocket construction.

(2) Related Art

In the apparel industry, the standard construction of a bag-type pocket is made so that the pocket material is folded in half, closed at the bottom and the top. As in the case of jeans/pants/casuals "bottoms", in most cases there is a fabric piecing which is attached to the front side of the pocketing fabric piecing as a "pocket facing". This pocket facing part is attached directly on top of the pocketing fabric piecing and functions as a deco piecing and a wear barrier for the user when putting his or her hand in their pocket. However, this conventional construction uses pocketing fabric piecing underneath the pocket facing part that neither is seen nor serves a unique purpose.

In the past, the pocketing fabric piecing has been attached to the garment in several different ways. One method is to attach the pocket facing part to a defined part of the pocketing fabric piecing. This attachment method varies on the finished appearance that the designer is trying to achieve. Once the pocket facing part is attached to the pocketing fabric piecing, (bottom slash or scoop front pockets) the sewing machine operator then takes the pocketing fabric piecing, folds it in half, closes the bottom of the pocket, sets the side edges of the pocketing fabric piecing into the out seam (side seam) and the top of the fabric into waistband or to the waistband.

The pocket facing part is attached to the front side of the pocketing fabric piecing, which acts as a barrier from the user placing items in the pockets. The pocket facing part also acts a decorative panel normally made of the same fabric as the principle part of the garment.

Thus, there remains a need for a new and improved bottom garment having an improved pocket construction which reduces the amount of pocketing fabric required while, at the same time, provides a level of appearance, strength and durability similar to conventional garments.

SUMMARY OF THE INVENTIONS

The present inventions are directed to a garment having an improved pocket construction. The garment includes a garment body and at least one partial bag pocket attached to the garment body. The garment may also include a finished edge along the lower portion of the at least one partial bag pocket for providing reinforcement. Finally, the garment may also include a closure.

Preferably, the garment is selected from the group consisting of jeans, pants, culottes, shorts, skirts, shirts and jackets. In one embodiment, the garment may further include a pair of legs attached to the garment body. In another embodiment, the garment may further include a pair of sleeves attached to the garment body. In other embodiments, the garment may further including a collar attached to the garment body or further include a hood attached to the garment body.

In one embodiment, the at least one partial bag pocket includes an inside face forming the partial pocket and an outside face adjacent to the wearer's body constructed of a cosmetically similar material as the garment body. The at least one partial bag pocket may be a one-piece construction.

In one embodiment, the finished edge is a coverstitch seam. In another embodiment, the finished edge is a clean finish seam. The clean finished seam may be selected from the group consisting of overlock, coverstitch, safety stitch, serge and felled.

The closure may include a fly assembly. The fly assembly may be selected from the group consisting of zippers, buttons, hook and loop fasteners, snaps and string ties.

Accordingly, one aspect of the present invention is to provide a garment having an improved pocket construction, the garment including: (a) a garment body; and (b) at least one partial bag pocket attached to the garment body.

Another aspect of the present invention is to provide a garment having an improved pocket construction, the garment including: (a) a garment body; (b) at least one partial bag pocket attached to the garment body; and (c) a finished edge along the lower portion of the at least one partial bag pocket for providing reinforcement.

Still another aspect of the present invention is to provide a garment having an improved pocket construction, the garment comprising: (a) a garment body; (b) at least one partial bag pocket attached to the garment body; (c) a finished edge along the lower portion of the at least one partial bag pocket for providing reinforcement; and (d) a closure.

These and other aspects of the present invention will become apparent to those skilled in the art after a reading of the following description of the preferred embodiment when considered with the drawings.

DESCRIPTION OF THE PREFERRED EMBODIMENTS

Figure 1:
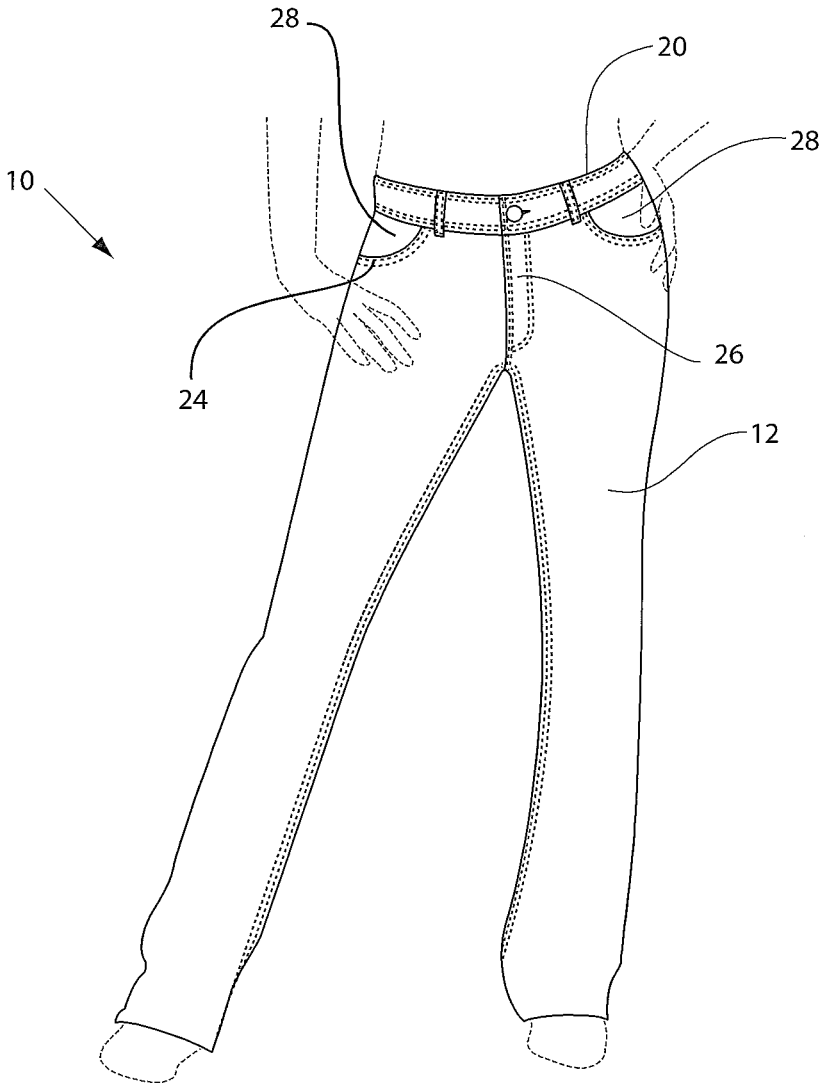
FIG. 1 is a front photograph of a garment constructed according to the present inventions as worn by the user.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the inventions and are not intended to limit the inventions thereto. As best seen in FIG. 1, a bottom garment, generally designated 10, is shown constructed to the present inventions. The bottom garment 10 includes two major sub-assemblies: a front panel 12; and a back panel 14. A waistband 20 extends across the front panel 12 and the back panel 14.

As also seen in FIG. 1, there is a front photograph of a bottom garment 10 constructed according the present inventions as worn by a user. The appearance of bottom garment 10 from the front is generally conventional in design. However, the bottom garment 10 further includes pocket assemblies 24 constructed according to the present inventions that include a pocket facing part 28 and a partial pocketing fabric piecing 52, which will be discussed in greater detail below.

Figure 2:
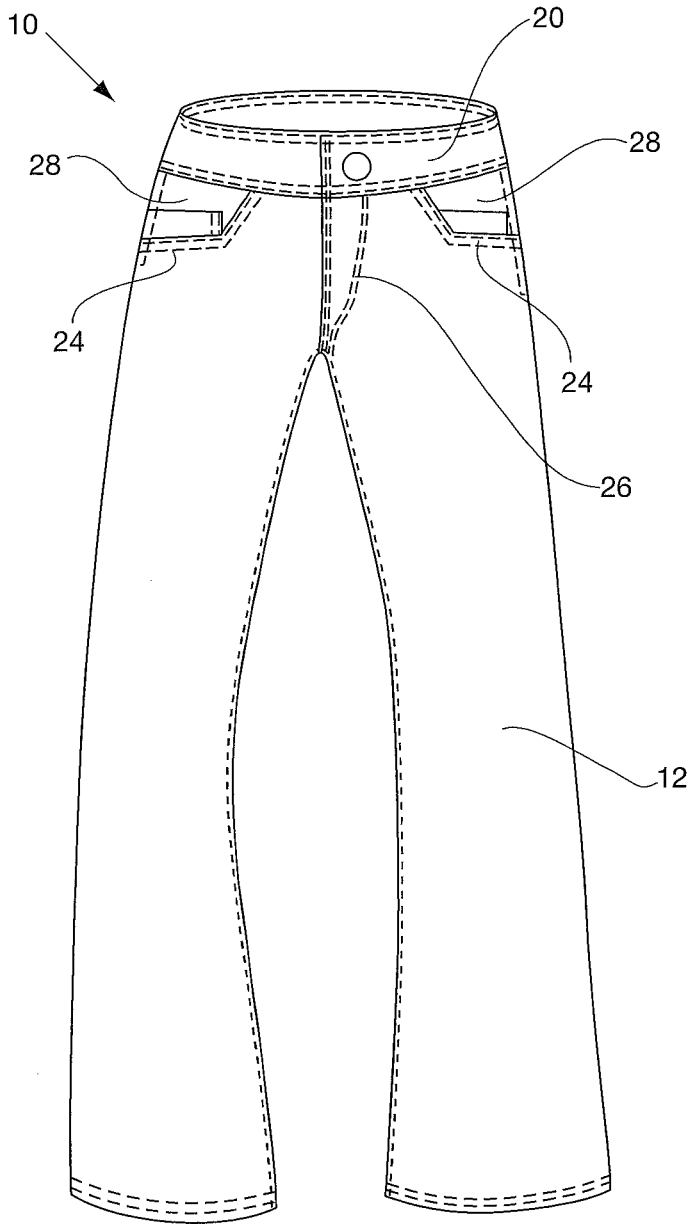
FIG. 2 is a front view of the garment shown in FIG. 1.
Figure 3:
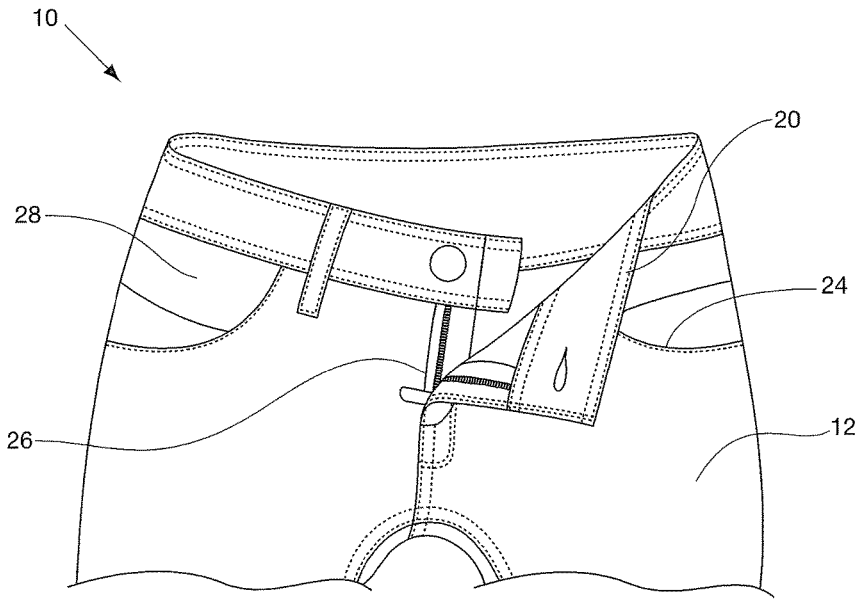
FIG. 3 is an enlarged front view of the garment shown in FIG. 2.

As best seen in FIGS. 2 and 3, the bottom garment 10 may also further include a fly assembly 26 which may consists of zippers, buttons, hook and loop fasteners, hook and eye snap, string ties, and other conventional fly assemblies as shown in FIG. 3, which is an enlarged front view of the bottom garment as shown in FIG. 2.

Figure 4:
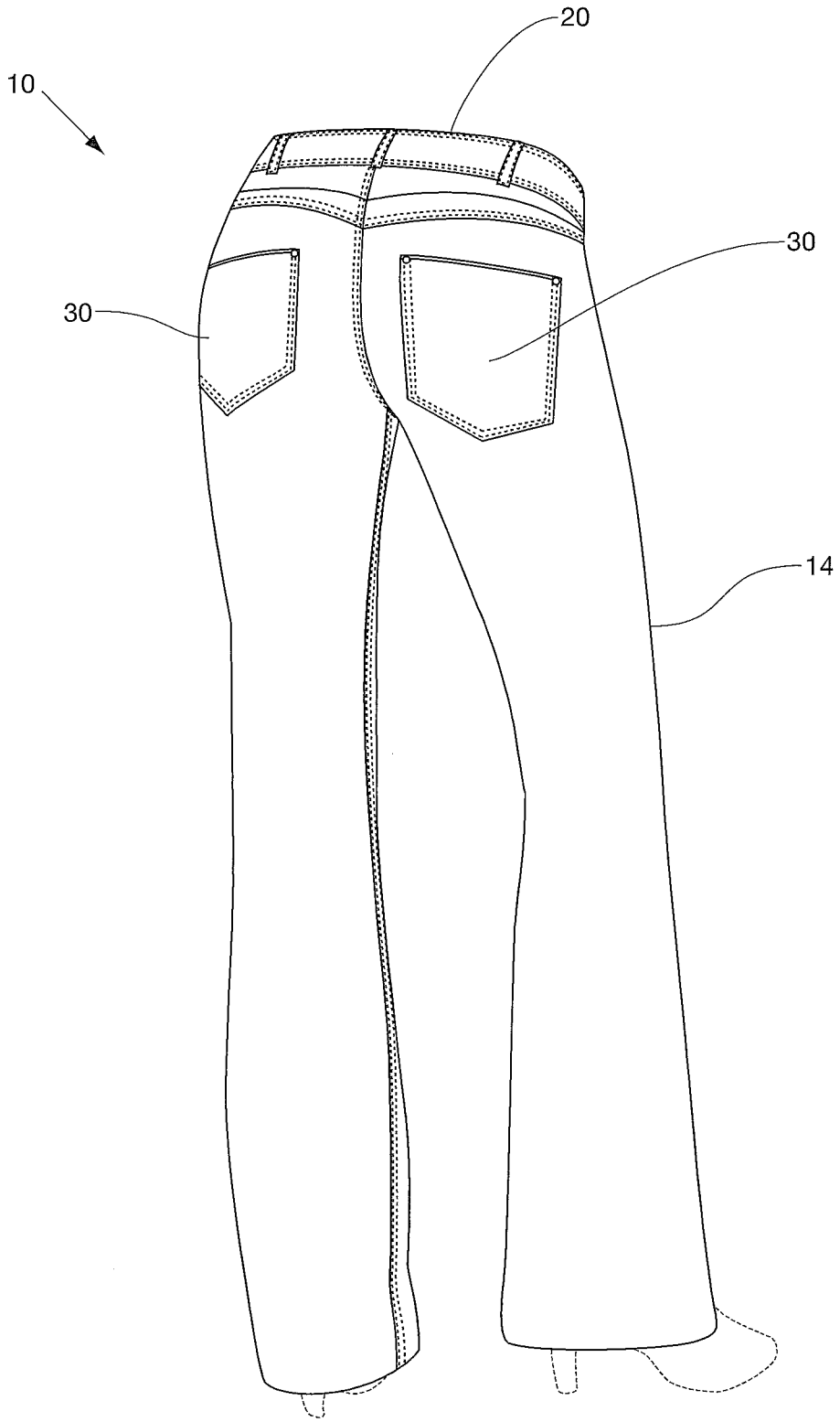
FIG. 4 is a back photograph of the garment shown in FIG. 1 as worn by a user.

Turning next to FIG. 4, there is shown a back photograph of the bottom garment 10 shown in FIG. 1 as worn by the user. The appearance of bottom garment 10 from the rear is generally conventional in design. Back panel 14 may further include a hip pocket assembly 30. Hip pocket assembly 30 may be selected from the group consisting of patch pockets, welt pockets, insert pockets and hidden pockets and other conventional pockets.

Figure 5:
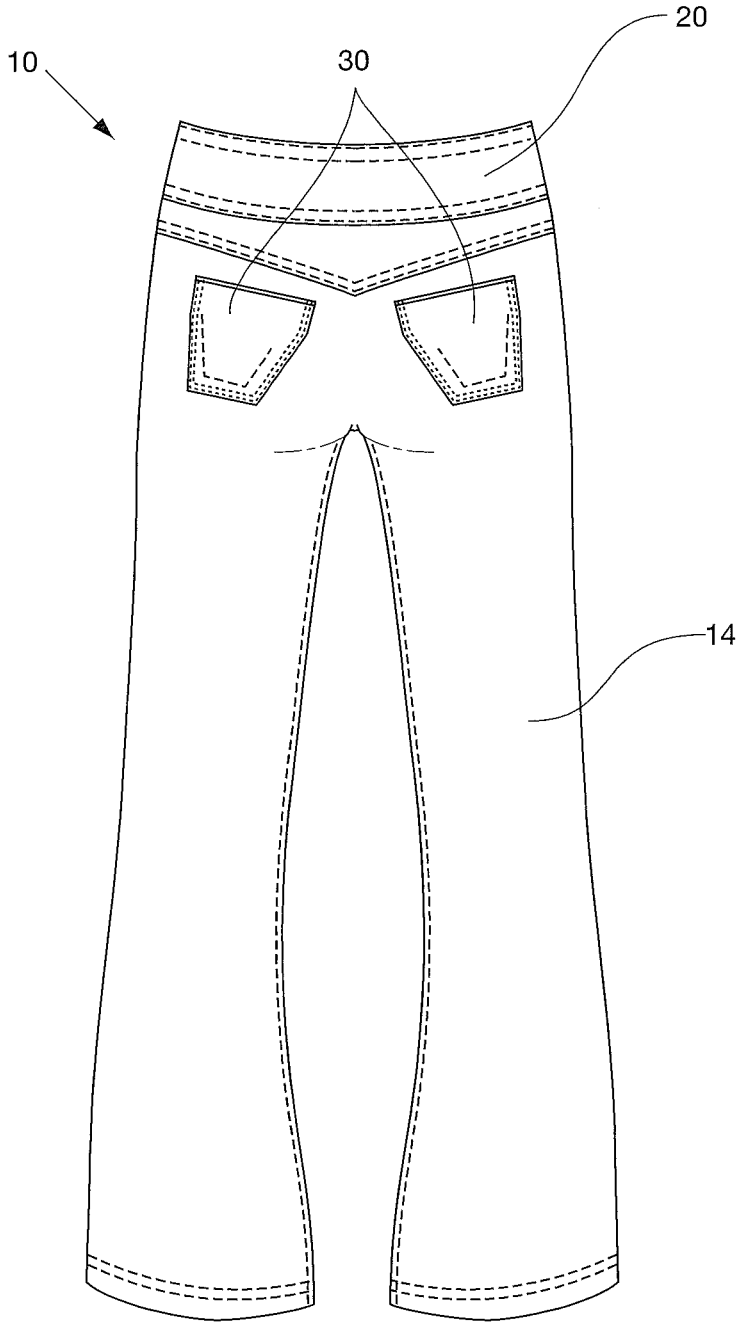
FIG. 5 is a back view of the garment shown in FIG. 4.

As best seen in FIG. 5, the back view of the garment 10 is substantially conventional in appearance.

Figure 6A:
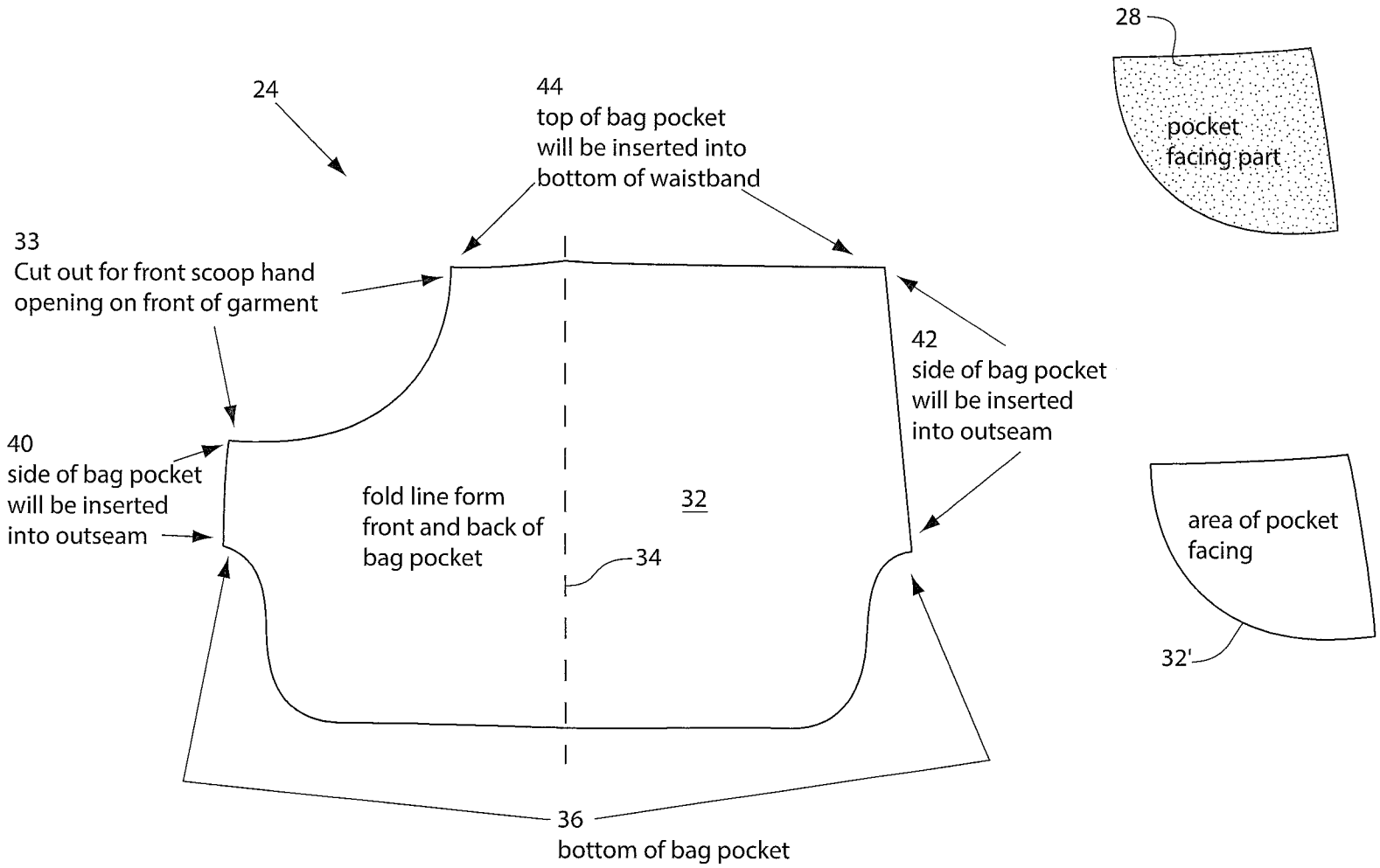
FIGS. 6A-6C illustrate the construction details of prior art front scoop bag pockets.
Figure 6B:
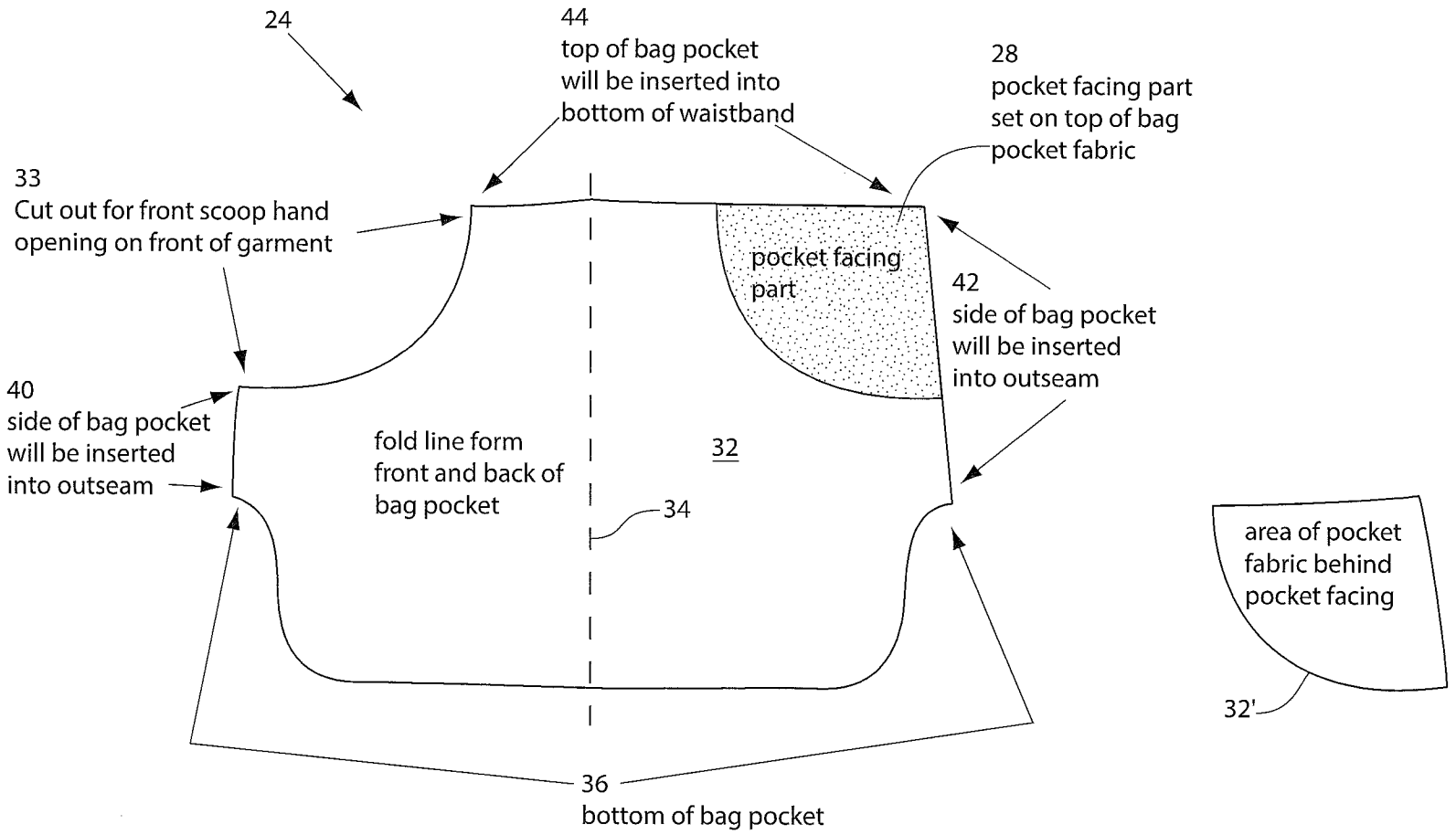
Figure 6C:
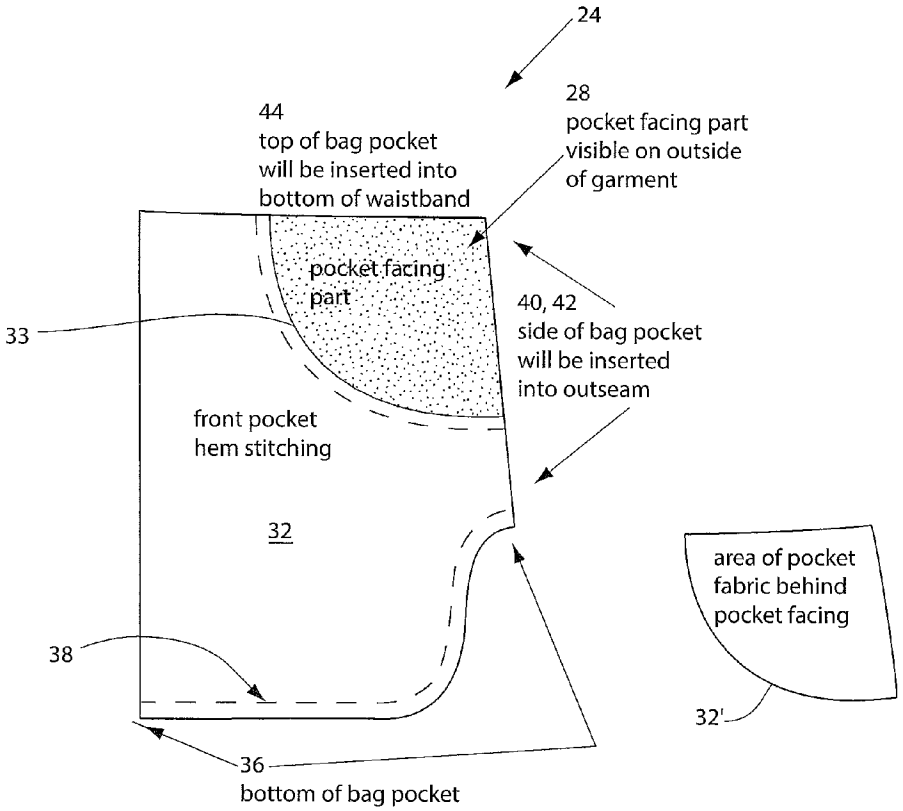

FIGS. 6A-6C illustrate the construction details of prior art front scoop bag pockets 24. As can be seen in FIG. 6A, in the standard construction of a bag-type pocket 24 there is a pocket facing part 28 that is attached to the front side of the pocketing fabric piecing 32. As seen in FIG. 6B, this pocket facing part 28 is attached directly on top of the pocketing fabric piecing 32.

Turning to FIG. 6C, once the pocket facing part 28 is attached to the pocketing fabric piecing 32, (bottom slash or scoop front pockets) the sewing machine operator then takes the pocketing fabric piecing 32, folds it in half along fold line 34, closes the bottom 36 of the pocketing fabric piecing 32 sets the side edges 40, 42 of the pocketing fabric piecing 32 into the out seam (side seam) and the top 44 of the pocketing fabric piecing 32 into or to the waistband 20 and cutout 33 is hemmed.

The pocket facing part 28 functions as a wear barrier from the user placing hands and other items in the pockets. The pocket facing part 28 also acts as a decorative panel normally made of the same fabric as the principle part of the garment 10. However, this conventional construction uses pocketing fabric piecing 32' underneath the pocket facing part 28 that neither is seen nor serves a unique purpose.

Figure 7A:
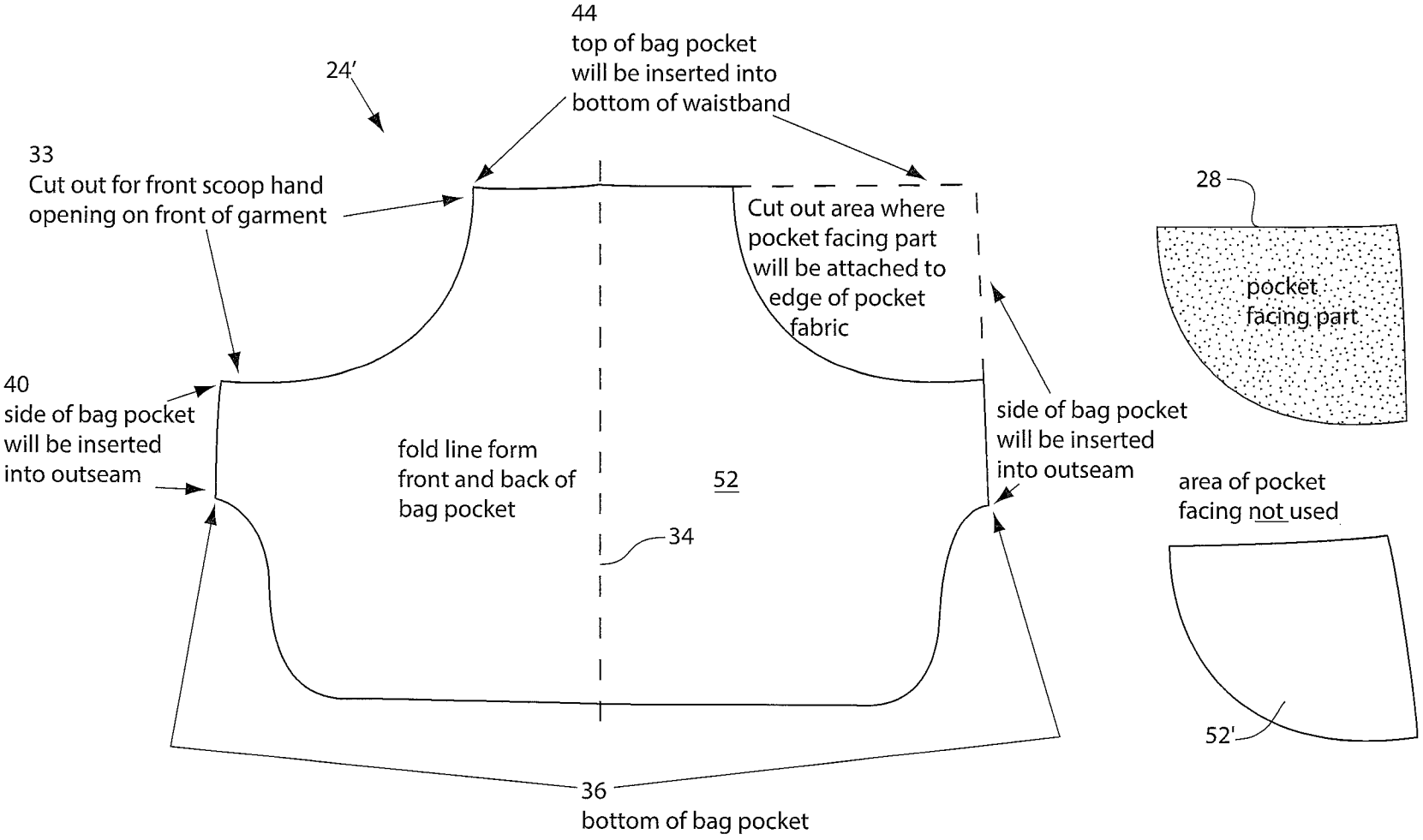
FIGS. 7A-7C illustrate the construction details of present inventions front scoop bag pockets having reduced pocketing fabric.
Figure 7B:
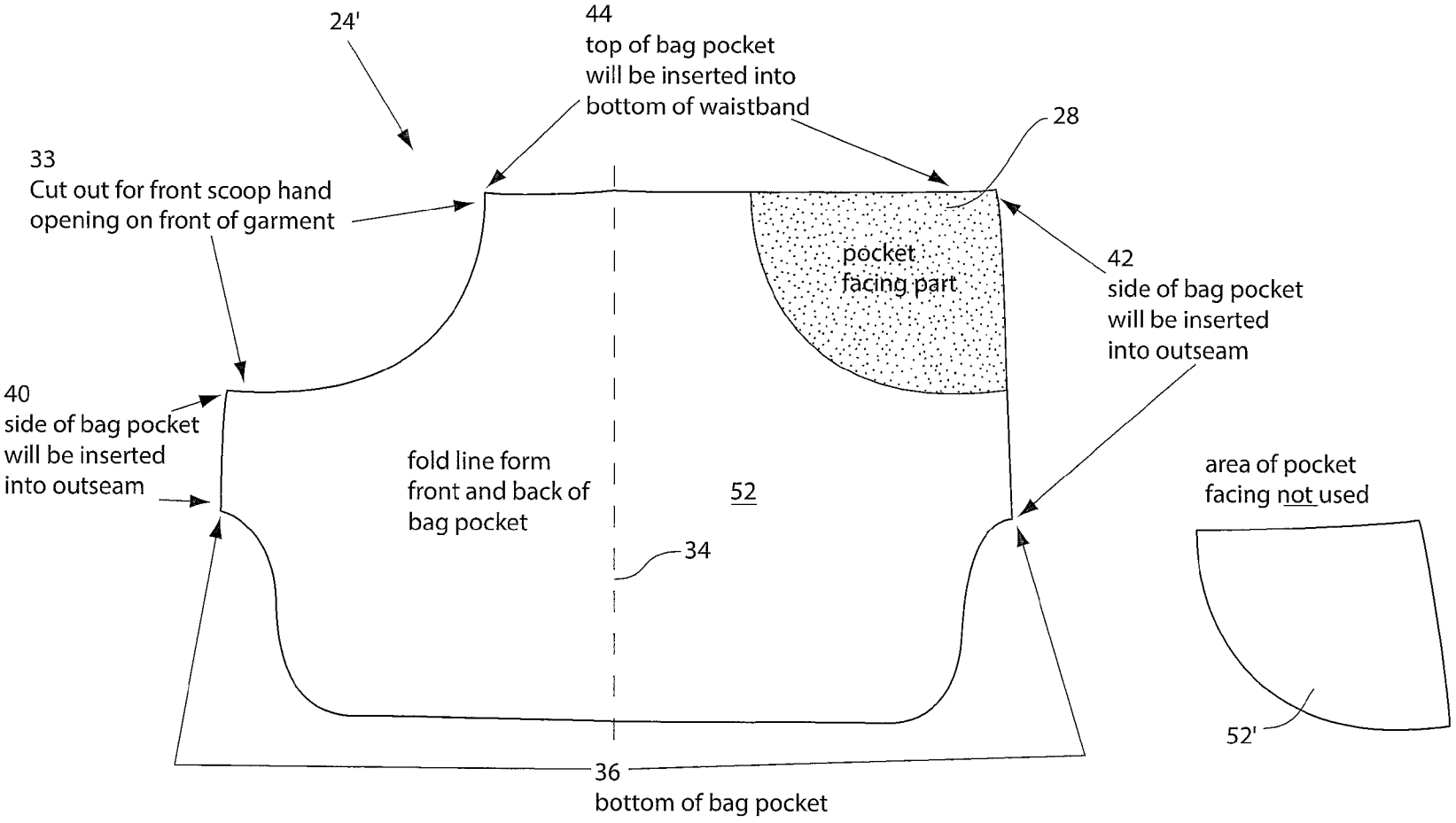
Figure 7C:
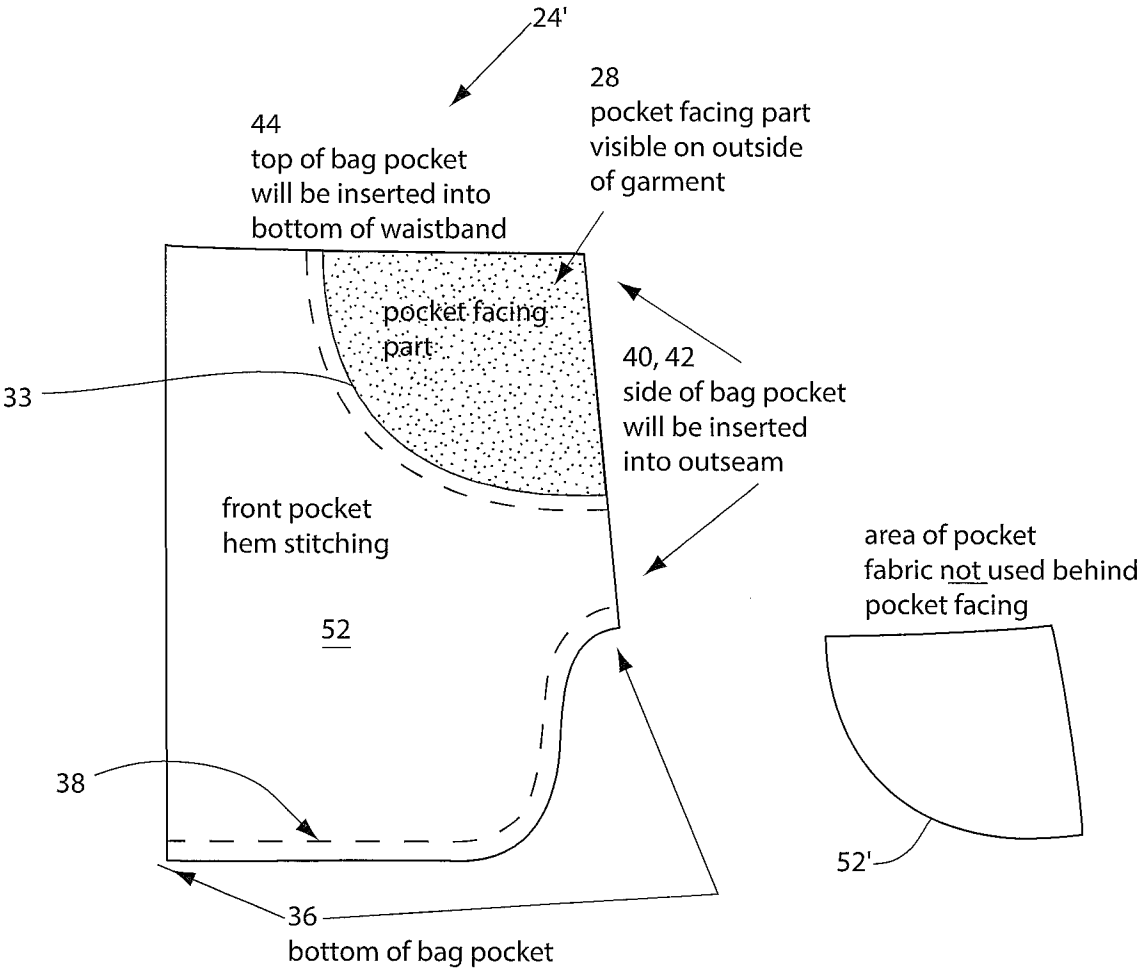

FIGS. 7A-7C illustrate the construction details of present inventions front scoop bag pockets 24' having reduced pocketing fabric piecing 52. As can be seen in FIG. 7A, unlike the standard construction of a bag-type pocket 24, pocket facing part 28 is not attached directly on top of the front side of the pocketing fabric piecing 52 since a portion 52' of pocketing fabric piecing 52 has been cut out forming a second scooped shaped cutout. As seen in FIG. 7B, pocket facing part 28 is attached instead to the edge of cutout 52' of the pocketing fabric piecing 52. In this example, the first scooped cutout 33 being a mirror image of the second scooped cutout 52', as shown, on an opposite side of the pocketing fabric piecing 52, such that as seen in FIG. 7C, the first scooped cutout and the second scooped cutout are aligned replicas of each other when the pocketing fabric piecing is folded upon itself.

Turning to FIG. 7C, once the pocket facing part 28 is attached to the edge of cutout 52' of the pocketing fabric piecing 52, (bottom slash or scoop front pockets) similar to the conventional method and the sewing machine operator then takes the pocketing fabric piecing 52, folds it in half along fold line 34, closes the bottom 36 of the pocketing fabric piecing 52, sets the side edges 40, 42 of the pocketing fabric piecing 52 into the out seam (side seam) and the top 44 of the pocketing fabric piecing 52 into or to the waistband 20 and cutout 33 is hemmed.

Similar to a conventional bag pocket 24, the pocket facing part 28 functions as a wear barrier from the user placing hands and other items in the pockets. The pocket facing part 28 also acts a decorative panel normally made of the same fabric as the principle part of the garment 10. However, the present inventions construction does not use the pocketing fabric piecing cutout 52' underneath the pocket facing part 28.

Figure 8:
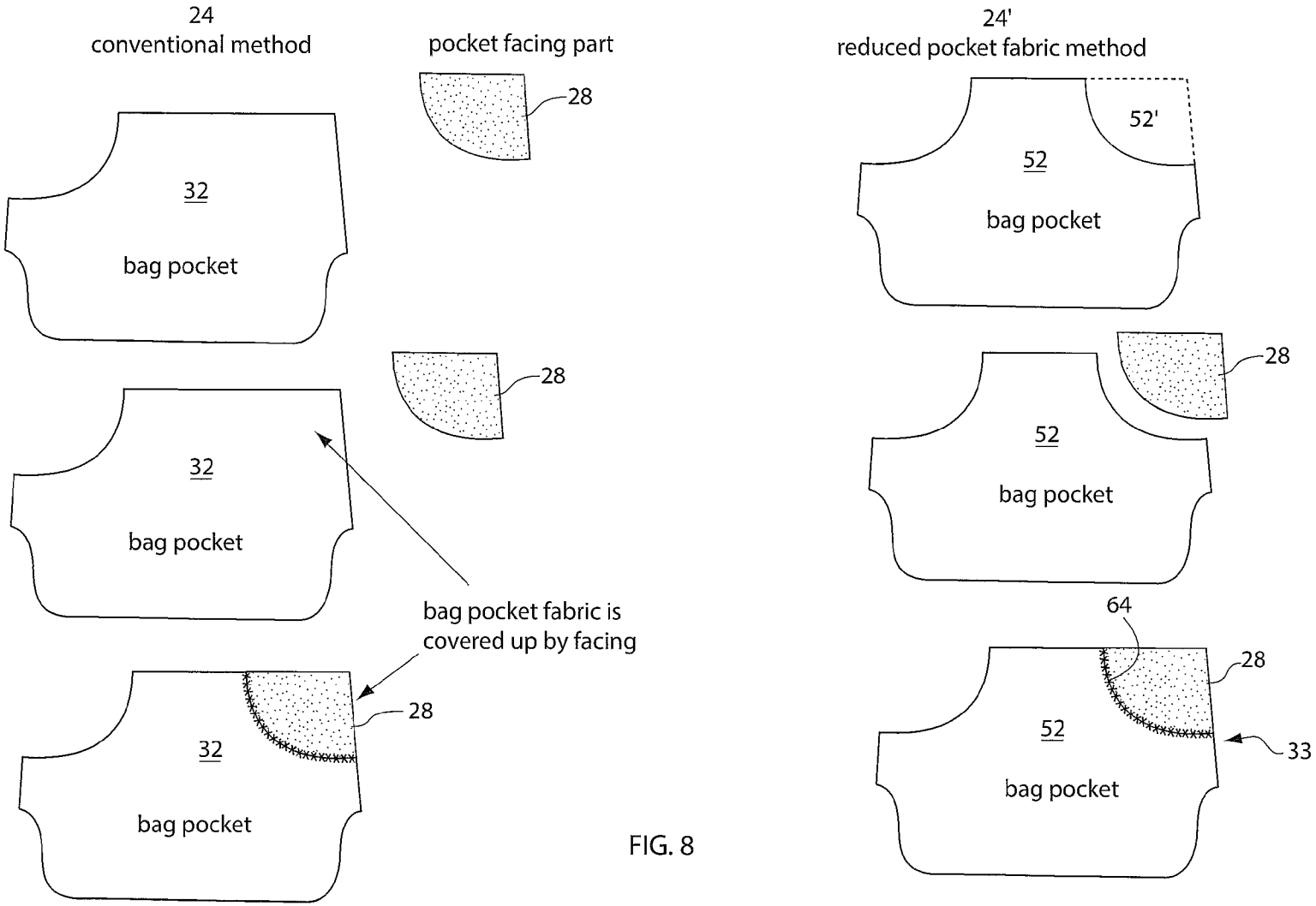
FIG. 8 is a schematic comparison of the construction details of the prior art and present inventions scoop bag pockets shown in FIGS. 6 and 7.

FIG. 8 is a schematic comparison of the construction details of the prior art pocket assembly 24 and present inventions pocket assembly 24' shown in FIGS. 6 and 7, respectfully.

The reduced pocketing fabric construction of the present inventions has the portion 52' of pocketing fabric piecing 52 behind the pocket facing part 28 eliminated. The amount of fabric eliminated will vary based on construction method used to attach the pocket facing part 28 and the pocketing fabric piecing 52.

Figure 9A:
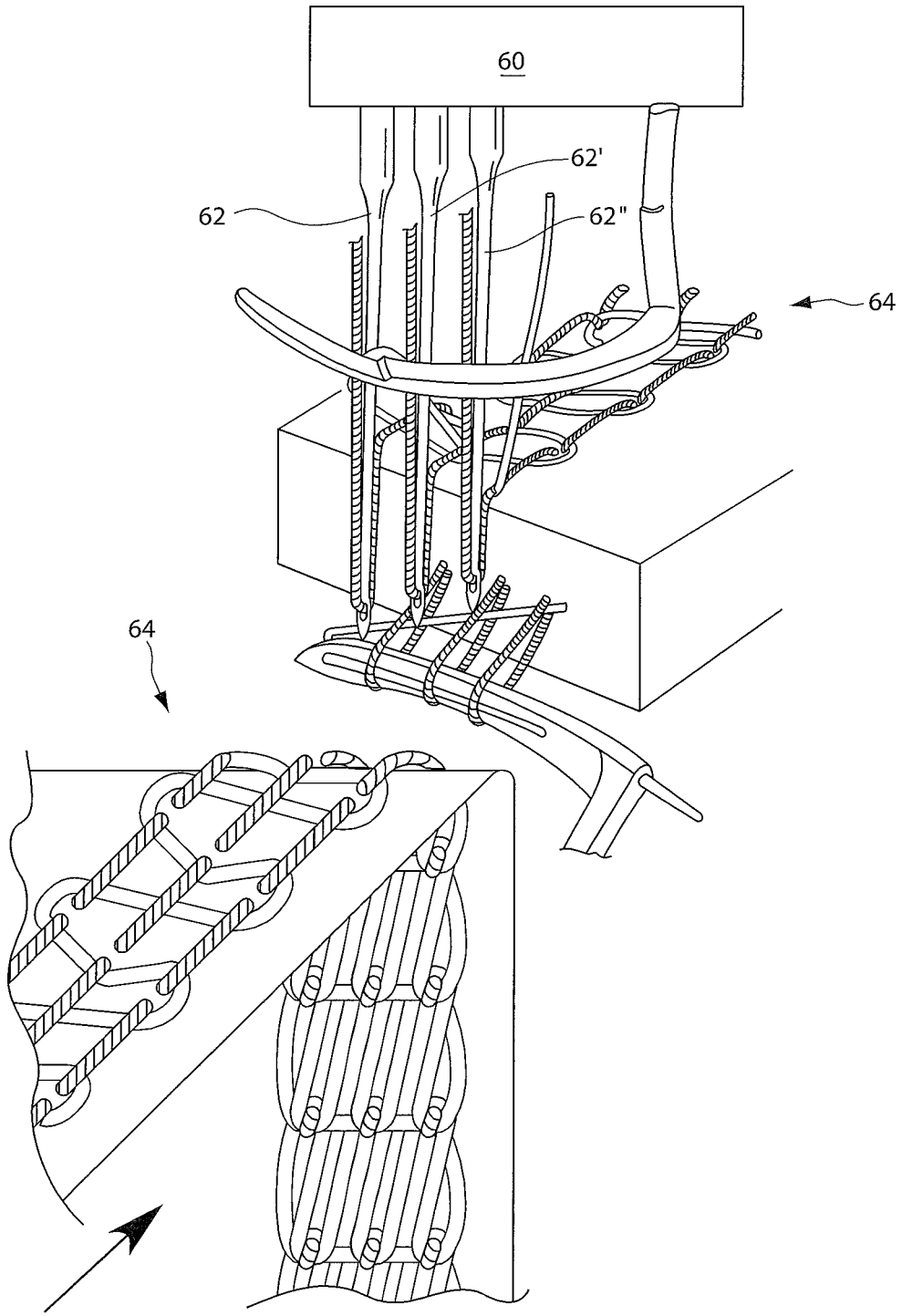
FIGS. 9A-9B illustrate an apparatus and stitch pattern for forming a coverstitch to join the pocket facing part and the pocketing fabric piecing together.
Figure 9B:
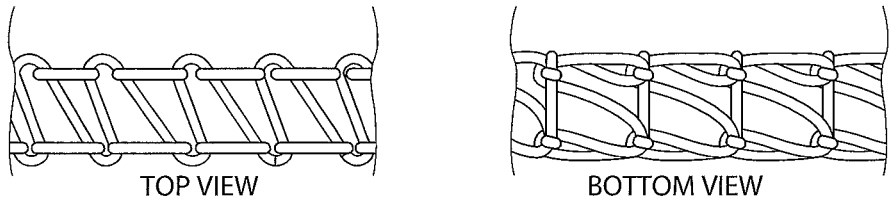
Figure 9B:
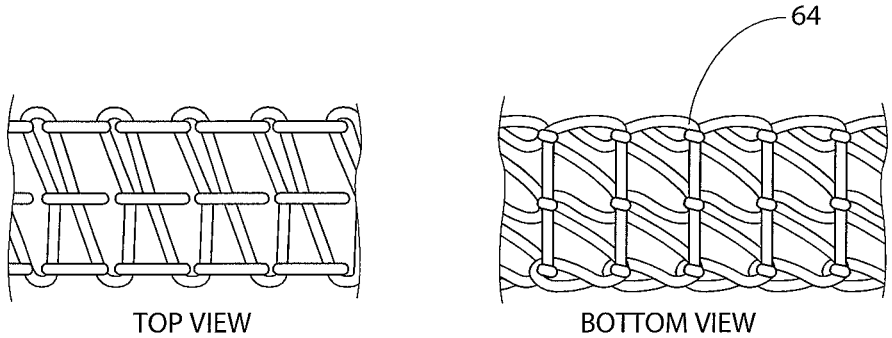
Figure 9B:
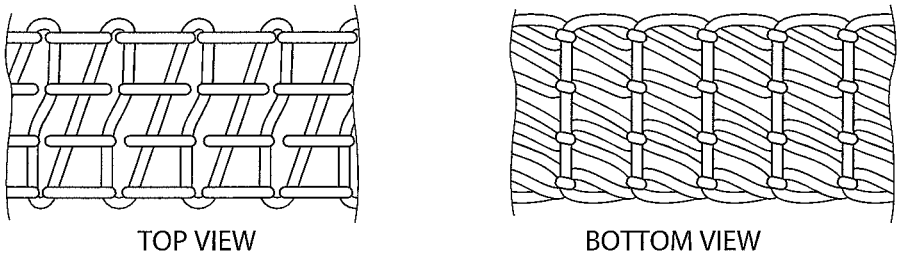

Attachment of the pocketing fabric piecing 52 to the pocket facing part 28 could be by several methods. FIGS. 9A-9B illustrate an apparatus and stitch pattern for forming a coverstitch to join the pocket facing part 28 and the pocketing fabric piecing 52 together. In this method, the pocket facing part 28 and the pocketing fabric piecing 52 are overlapped by ⅜" and both parts are sewn together using a sewing machine 60 that has 3 needles, 62, 62' and 62" spaced ⅛" apart and applies a coverstitch 64 to the edge on both the top and bottom part as the parts are being sewn together.

Figure 10B:
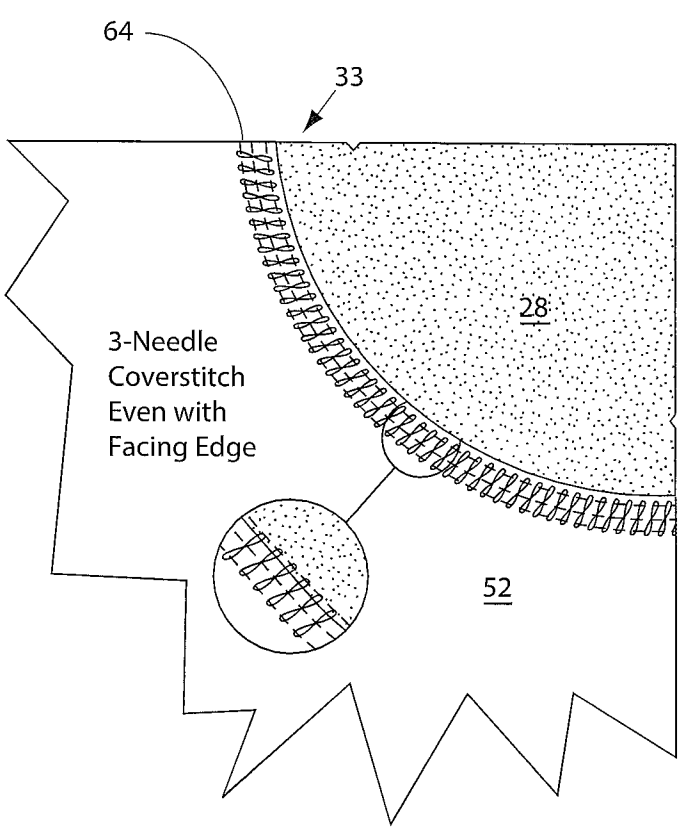
FIGS. 10A-10B illustrate the back and front view, respectfully, of a coverstitch joining the pocket facing part and the pocketing fabric piecing together.
Figure 10A:
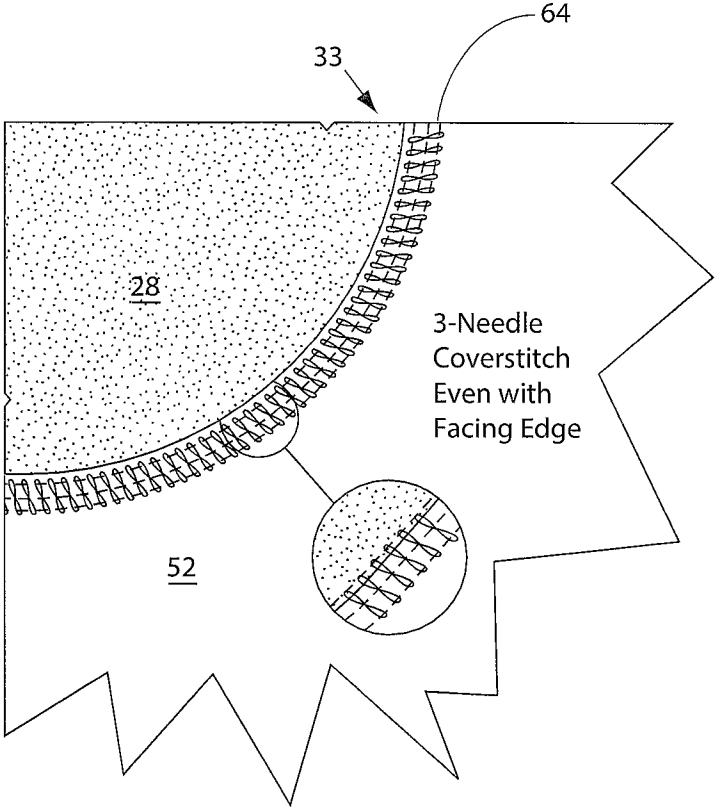
Figure 11A:
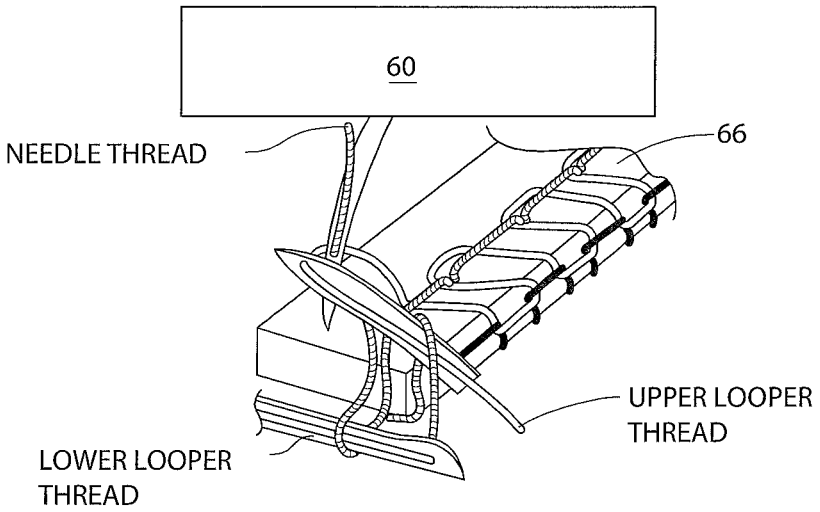
FIGS. 11A-11B illustrate an apparatus and stitch pattern for forming a serge stitch to join the pocket facing part and the pocketing fabric piecing together.
Figure 11A:
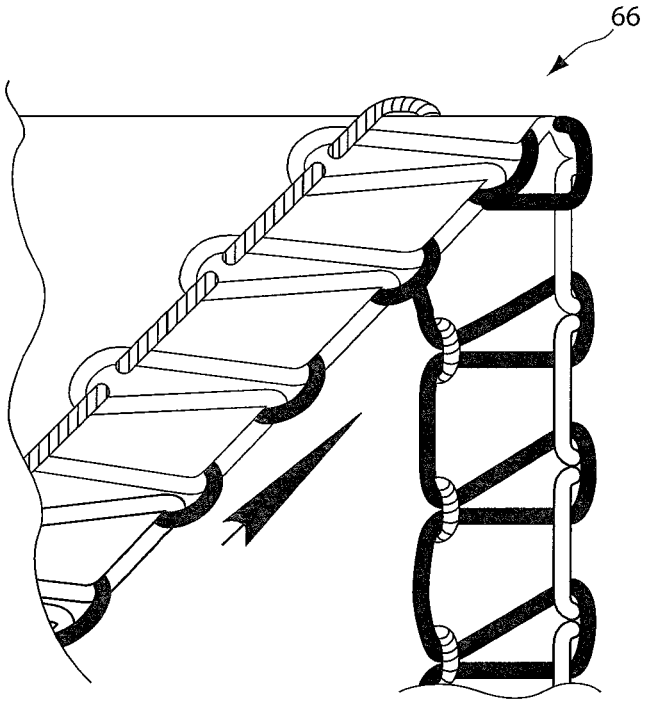
Figure 11B:
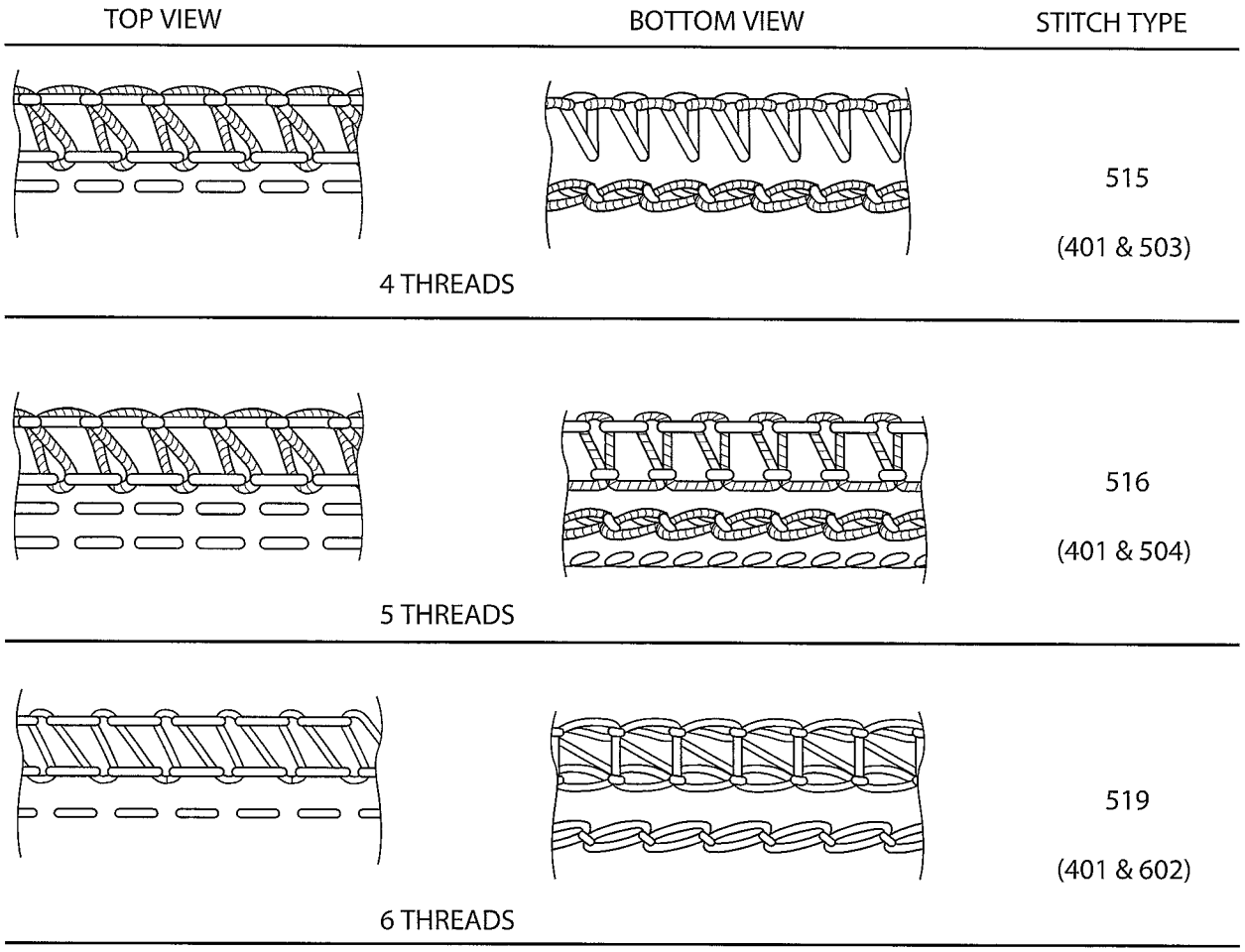

FIGS. 10A-10B illustrate the back and front view, respectfully, of a coverstitch 64 joining the pocket facing part 28 and the pocketing fabric piecing 52 together;

Another method shown in FIGS. 11A-11B is to sew the pocket facing part 28 to the edge 33 of the cutout 52' of the pocketing fabric piecing 52 with a serge stitch 66, then turn the pocket back and then one needle top stitch 68 over the serge stitch 66. Once the pocket facing part 28 and the pocketing fabric piecing 52 are attached the remainder of the garment 10 would follow conventional methods of closing the bottom 36 of the pocket, attachment to outseam (side seam) and attachment to the waistband 20 at the top 44.

Yet another method is a variation of the method shown in FIGS. 11A-11B in which the serge stitch 66 is used to sew the pocket facing part 28 to the edge 33 of the cutout 52' of the pocketing fabric piecing 52 with a serge stitch 66 but without top stitching 68.

Figure 12A:
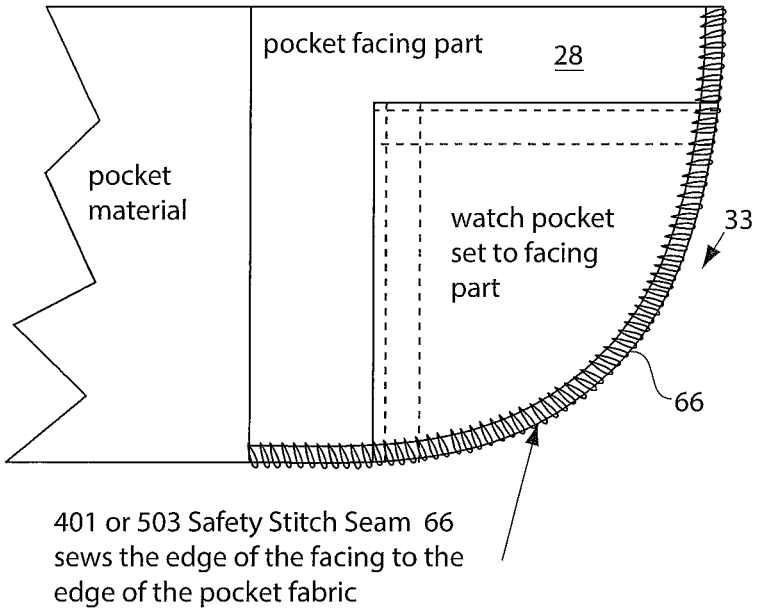
FIGS. 12A-12B illustrate a serge stitch joining the pocket facing part and the pocketing fabric piecing together followed by a top stitch.
Figure 12B:
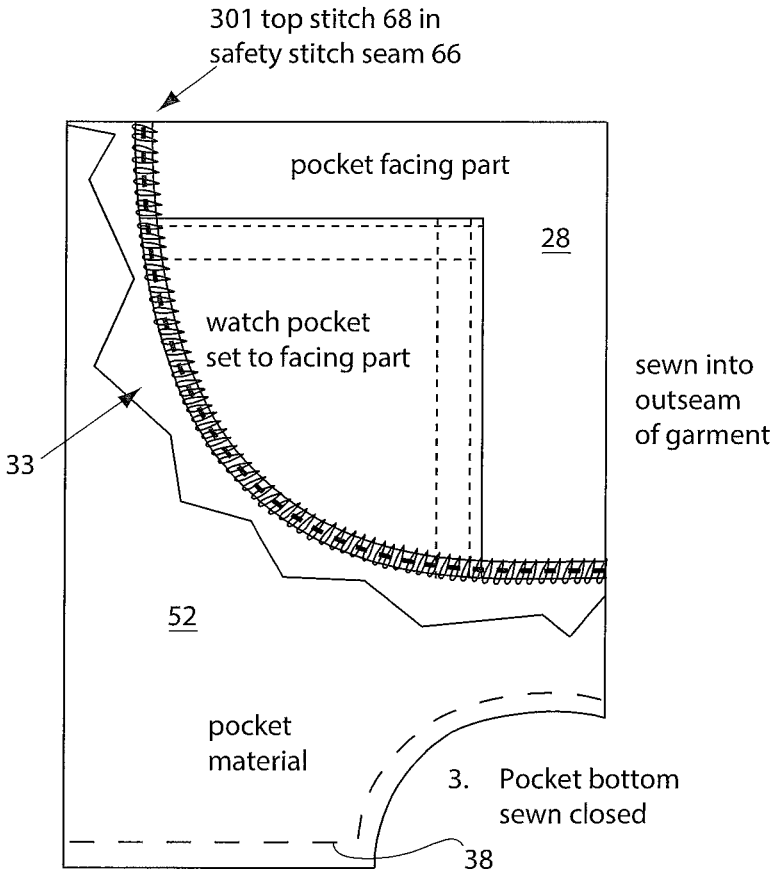

FIGS. 12A-12B illustrate the method of 'stitch-turn-stitch' of a serge stitch 66 joining the pocket facing part 28 and the pocketing fabric piecing 52 together followed by a top stitch 68.

Figure 13:
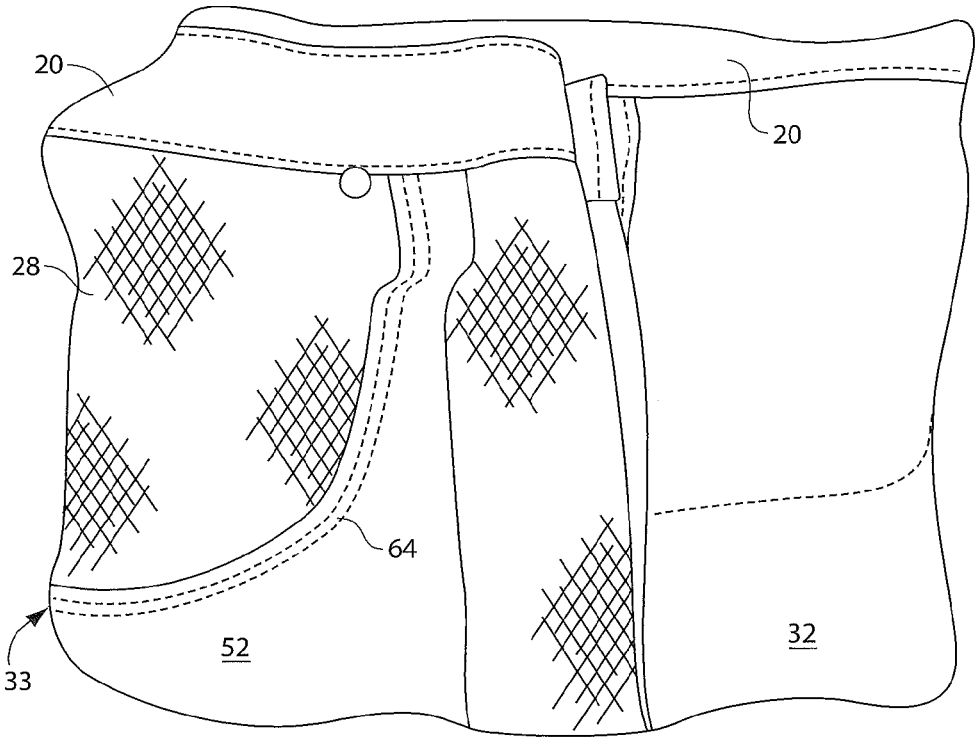
FIG. 13 is a side-by-side comparison of completed garments having a prior art front scoop bag pocket and a present inventions front scoop bag pocket.

FIG. 13 is a side by side comparison of completed garments 10 having a prior art front scoop bag pocket 24 and a present inventions front scoop bag pocket 24'.

Figure 14:
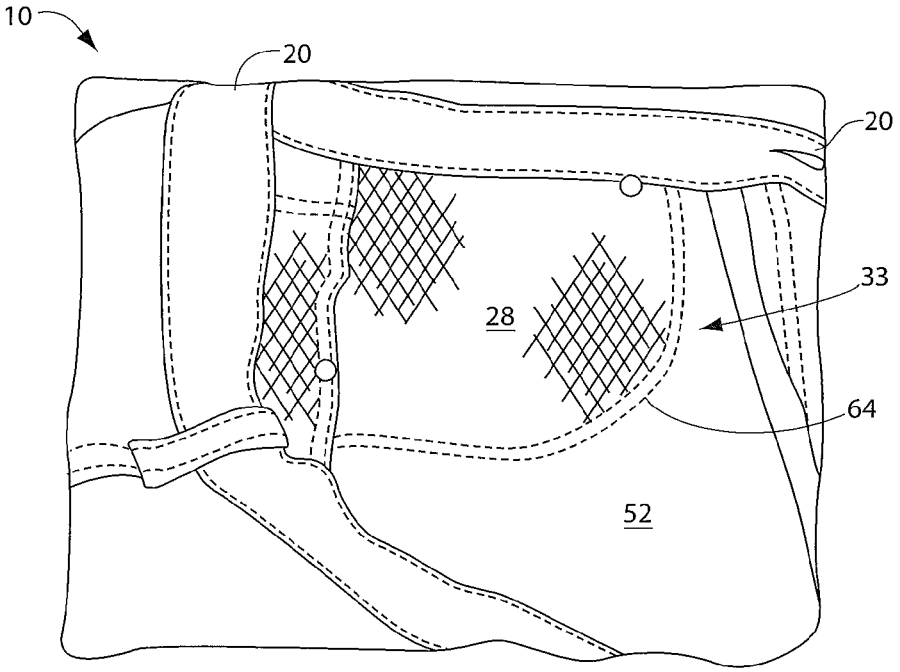
FIG. 14 is an enlarged view of the completed garment shown in FIG. 13 having a present inventions front scoop bag pocket.

FIG. 14 is an enlarged view of a completed garment shown in FIG. 13 having a present inventions front scoop bag pocket 24'.

Testing was conducted where prototype pockets were constructed using the above mentioned sewing methods. The refined pockets were then sewn into prototype garments for evaluation for strength and durability. Another test was conducted to determine if the new modifications would be acceptable to the Consuming public. This testing concluded that the consuming public did not notice the modification nor did it generate any concern with regard to construction of the garment.

On some garments, a patch pocket will be attached to contain coins, keys or other small items. It is a common practice to apply decorative stitching to include embroidery to the pocket facing part. The pocketing fabric piecing is placed inside and/or attached to the waistband to add support to the pocket structure. Laboratory testing has shown that little or no significant strength is lost by eliminating the pocketing fabric piecing from behind the pocket facing part.

The present inventions may be applied to all garments that have a bag pocket, such as scoop, slash or welt pockets. The present inventions could also be used on pockets such as jackets or other tops where pocketing material is being used.

Thus, according to the present inventions, removing part of the pocketing fabric piecing from behind the pocket facing part, less fabric weight and bulk can be incorporated in the construction of a garment and by attaching the facing to the outside edge of the pocketing fabric piecing, the quantity of pocketing fabric needed is reduced. This reduction eliminates excess fabric that serves little to no real value to the wearer and simply adds bulk to the garment. In the present inventions, the pocketing fabric being eliminated is not visible on the outside of the garment. Eliminating duplicate plies of fabric reduces overall materials and cost while, at the same time, permits the use of a single pocketing fabric piecing for both the left and right pockets of the garment.

Certain modifications and improvements will occur to those skilled in the art upon a reading of the foregoing description. By way of example, while one embodiment shown in the above disclosure illustrates a garment 10 that may include jeans, pants, culottes and shorts, it should be clear that the present inventions may be modified to further include skirts, shirts and jackets. Minimum components would entail, pocketing fabric material, pocket facing material and means to attach the parts such as thread. Other components could be varying types of fabric, printed or colored pocketing fabric piecing, vary the shape or size of the pocket facing part or pocketing. For some sizes, the pocket facing part may be extended to eliminate the need for any pocketing fabric material on the back side of a bag pocket, such as Infant and Toddler garments. These inventions would also apply to pocket application in which a bearer piecing, of any material, is being used and possibility to remove pocketing fabric material from behind the bearer piecing. In addition, the inventions may apply to garments having a single ply right fly. It should be understood that all such modifications and improvements have been deleted herein for the sake of conciseness and readability but are properly within the scope of the following claims.

I claim:

1. A garment including a pocket construction, said garment comprising:

(a) a garment body;

(b) at least one partial bag pocket attached to said garment body, said at least one partial bag pocket, including:

a first large pocketing fabric piecing, a first scooped cutout extending from a top of said pocketing fabric piecing to a side of said pocketing fabric piecing, a second scooped mirror image cutout on an opposite side of said pocketing fabric piecing from said first cutout and extending from a top of said pocketing fabric piecing to a side of said pocketing fabric piecing, a second pocket facing part piecing made of a same material as the garment, said second pocket facing part piecing being smaller than said first large pocketing fabric piecing and having a rounded edge, wherein said rounded edge mates with one of said first or second scooped cutouts such that said large pocketing fabric piecing is attached to said smaller second pocket facing part piecing, (c) a finished edge along the lower portion of said at least one partial bag pocket for providing reinforcement, and (d) wherein at least a portion of said large pocketing fabric piecing along a top of the piecing interfaces with a waistband of said garment and said cutout in the scooped areas of the cutout is separated from a waistband of said garment, and wherein said second pocket facing part interfaces directly with a lower edge of said waistband along a top edge of the second pocket facing part.

2. The garment according to claim 1, wherein said at least one partial bag pocket includes (i) an inside face forming the partial pocket and (ii) an outside face adjacent to the wearer's body constructed of a cosmetically similar material as said garment body.

3. The garment according to claim 2, wherein said at least one partial bag pocket is a one-piece construction.

4. The garment according to claim 1, wherein said finished edge is a coverstitch seam.

5. The garment according to claim 1, wherein said finished edge is a clean finish seam.

6. The garment according to claim 5, wherein said clean finished seam is selected from the group consisting of overlock, coverstitch, safety stitch, serge and felled.

* * * * *